US012371800B2

(12) United States Patent
Matsuda et al.

(10) Patent No.: US 12,371,800 B2
(45) Date of Patent: Jul. 29, 2025

(54) PICKLING APPARATUS AND PICKLING METHOD

(71) Applicant: PRIMETALS TECHNOLOGIES JAPAN, LTD., Hiroshima (JP)

(72) Inventors: Naohiko Matsuda, Tokyo (JP); Takashi Nakano, Tokyo (JP); Yuki Maehashi, Tokyo (JP); Shinji Namba, Tokyo (JP); Masashi Yoshikawa, Tokyo (JP); Kosei Tsuji, Hiroshima (JP); Takahiro Yagi, Hiroshima (JP); Ryusuke Nakatsuka, Hiroshima (JP)

(73) Assignee: PRIMETALS TECHNOLOGIES JAPAN, LTD., Hiroshima (JP)

( * ) Notice: Subject to any disclaimer, the term of this patent is extended or adjusted under 35 U.S.C. 154(b) by 0 days.

(21) Appl. No.: 18/571,939

(22) PCT Filed: Jul. 9, 2021

(86) PCT No.: PCT/JP2021/025980

§ 371 (c)(1),
(2) Date: Dec. 19, 2023

(87) PCT Pub. No.: WO2023/281739

PCT Pub. Date: Jan. 12, 2023

(65) Prior Publication Data

US 2024/0287685 A1 Aug. 29, 2024

(51) Int. Cl.
*C23G 3/02* (2006.01)

(52) U.S. Cl.
CPC ..... *C23G 3/025* (2013.01)

(58) Field of Classification Search
None
See application file for complete search history.

(56) References Cited

U.S. PATENT DOCUMENTS 5,810,939 A 9/1998 Angel et al.
6,174,383 B1 1/2001 Angel et al.
6,305,096 B1 * 10/2001 Hirai ..... C23G 3/021 134/122 R (Continued)

FOREIGN PATENT DOCUMENTS

EP 0 984 080 B1 10/2002
JP 9-170090 A 6/1997

(Continued)

OTHER PUBLICATIONS

International Preliminary Report on Patentability and Written Opinion of the International Searching Authority for International Application No. PCT/JP2021/025980, dated Jan. 18, 2024, with an English translation.

(Continued)

*Primary Examiner* — Michael E Barr
*Assistant Examiner* — Pradhuman Parihar
(74) *Attorney, Agent, or Firm* — BIRCH, STEWART, KOLASCH & BIRCH, LLP

(57) ABSTRACT

A pickling apparatus for pickling a strip of metal being conveyed is equipped with: a pickling tank for storing an acid solution; a surrounding part disposed in the pickling tank so as to surround the strip immersed in the acid solution in the pickling tank; and an oxidant supply part for supplying a liquid oxidant toward an inside of the surrounding part.

14 Claims, 10 Drawing Sheets

(56) References Cited

U.S. PATENT DOCUMENTS

2018/0312982 A1 11/2018 Nakatsuka et al.

FOREIGN PATENT DOCUMENTS

| | | | |
|---|---|---|---|
| JP | 2001-20086 | A | 1/2001 |
| JP | 2009-1876 | A | 1/2009 |
| JP | 2011-225907 | A | 11/2011 |
| JP | 2015-160148 | A | 9/2015 |
| KR | 10-1917531 | B1 | 11/2018 |
| WO | WO99/46427 | A1 | 9/1999 |
| WO | WO2017/187737 | A1 | 11/2017 |

OTHER PUBLICATIONS

Partial Supplementary European Search Report for European Application No. 21949371.5, dated Jun. 27, 2024.
International Search Report (PCT/ISA/210) issued in PCT/JP2021/025980 mailed on Aug. 31, 2021.

* cited by examiner

PICKLING APPARATUS AND PICKLING METHOD

TECHNICAL FIELD

The present disclosure relates to a pickling apparatus and a pickling method.

BACKGROUND

It is known that, in pickling a strip of metal (such as steel), a pickling speed is increased by regulating the concentration of ferric ions ($Fe^{3+}$) contained in an acid solution, and a method for regulating the concentration of $Fe^{3+}$ in the acid solution is proposed.

For example, Patent Document 1 describes that an acid solution in a pickling tank is circulated via a conduit connected to the pickling tank and hydrogen peroxide solution is supplied to the conduit, thereby oxidizing $Fe^{2+}$ in the acid solution to $Fe^{3+}$ and increasing the concentration of $Fe^{3+}$ in the acid solution.

CITATION LIST

Patent Literature

Patent Document 1: JPH9-170090A

SUMMARY

Technical Problem

Meanwhile, depending on how the liquid oxidant such as hydrogen peroxide solution is supplied to the acid solution, the liquid oxidant is likely to be consumed in a reaction different from the oxidation of $Fe^{2+}$. Since it is necessary to increase the supply amount of a liquid supply agent in order to appropriately oxidize $Fe^{2+}$, it is difficult to perform efficient pickling.

In view of the above, an object of at least one embodiment of the present invention is to provide a pickling apparatus and a pickling method which are capable of pickling a strip of metal more efficiently.

Solution to Problem

A pickling apparatus according to at least one embodiment of the present invention is a pickling apparatus for pickling a strip of metal being conveyed, including: a pickling tank for storing an acid solution; a surrounding part disposed in the pickling tank so as to surround the strip immersed in the acid solution in the pickling tank; and an oxidant supply part for supplying a liquid oxidant toward an inside of the surrounding part.

Further, a pickling method according to at least one embodiment of the present invention is a pickling method for pickling a strip of metal being conveyed, including: a step of conveying the strip in a state where the strip is immersed in an acid solution stored in a pickling tank and the strip is surrounded by a surrounding part disposed in the pickling tank; and a step of supplying a liquid oxidant toward an inside of the surrounding part.

Advantageous Effects

According to at least one embodiment of the present invention, in view of the above, the at least one embodiment of the present invention provides a pickling apparatus and a pickling method which are capable of pickling a strip of metal more efficiently.

DETAILED DESCRIPTION

Figure 1:
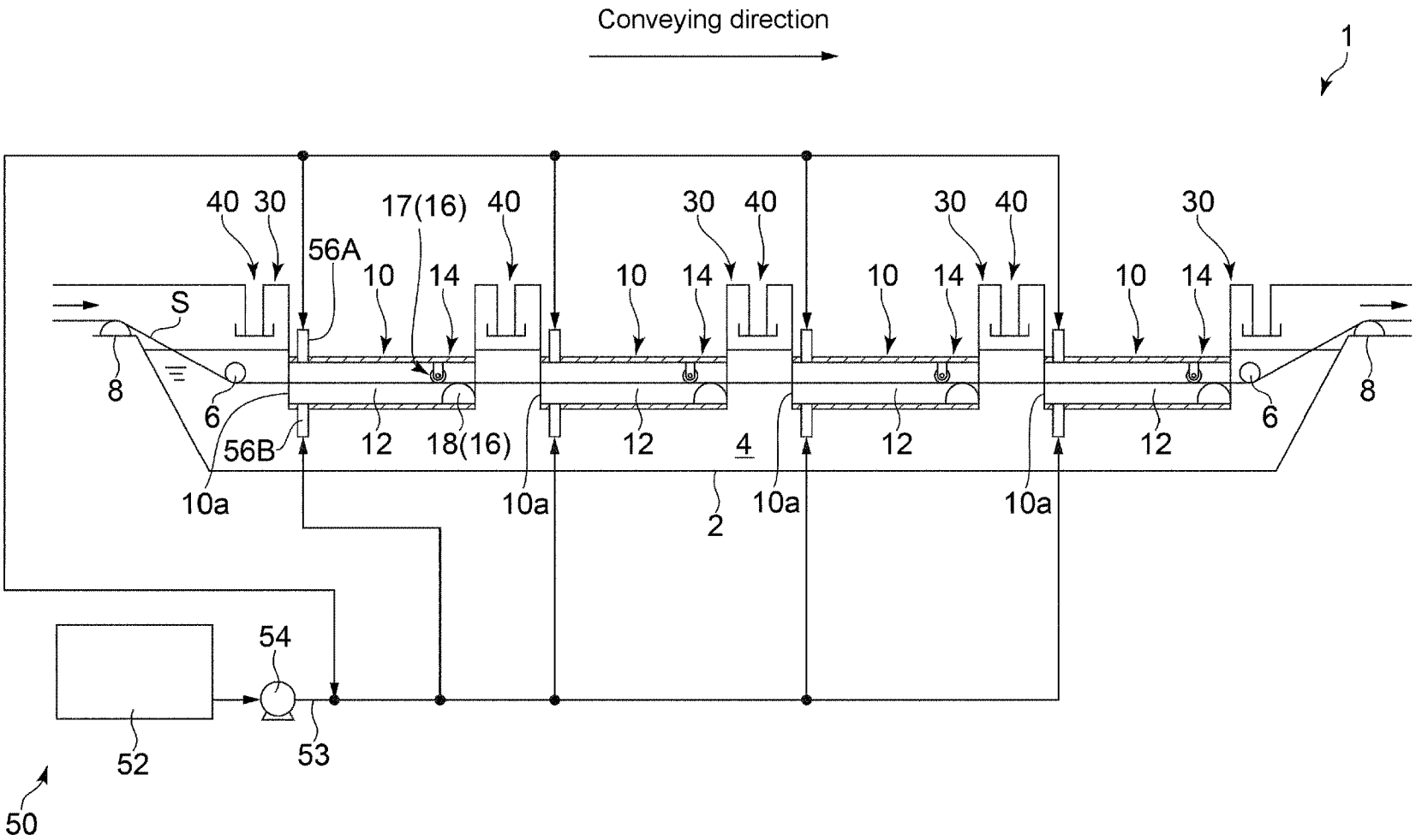
FIG. 1 is a schematic configuration view of a pickling apparatus according to an embodiment.

Some embodiments of the present invention will be described below with reference to the accompanying drawings. It is intended, however, that unless particularly identified, dimensions, materials, shapes, relative positions and the like of components described or shown in the drawings as the embodiments shall be interpreted as illustrative only and not intended to limit the scope of the present invention.

Figure 2:
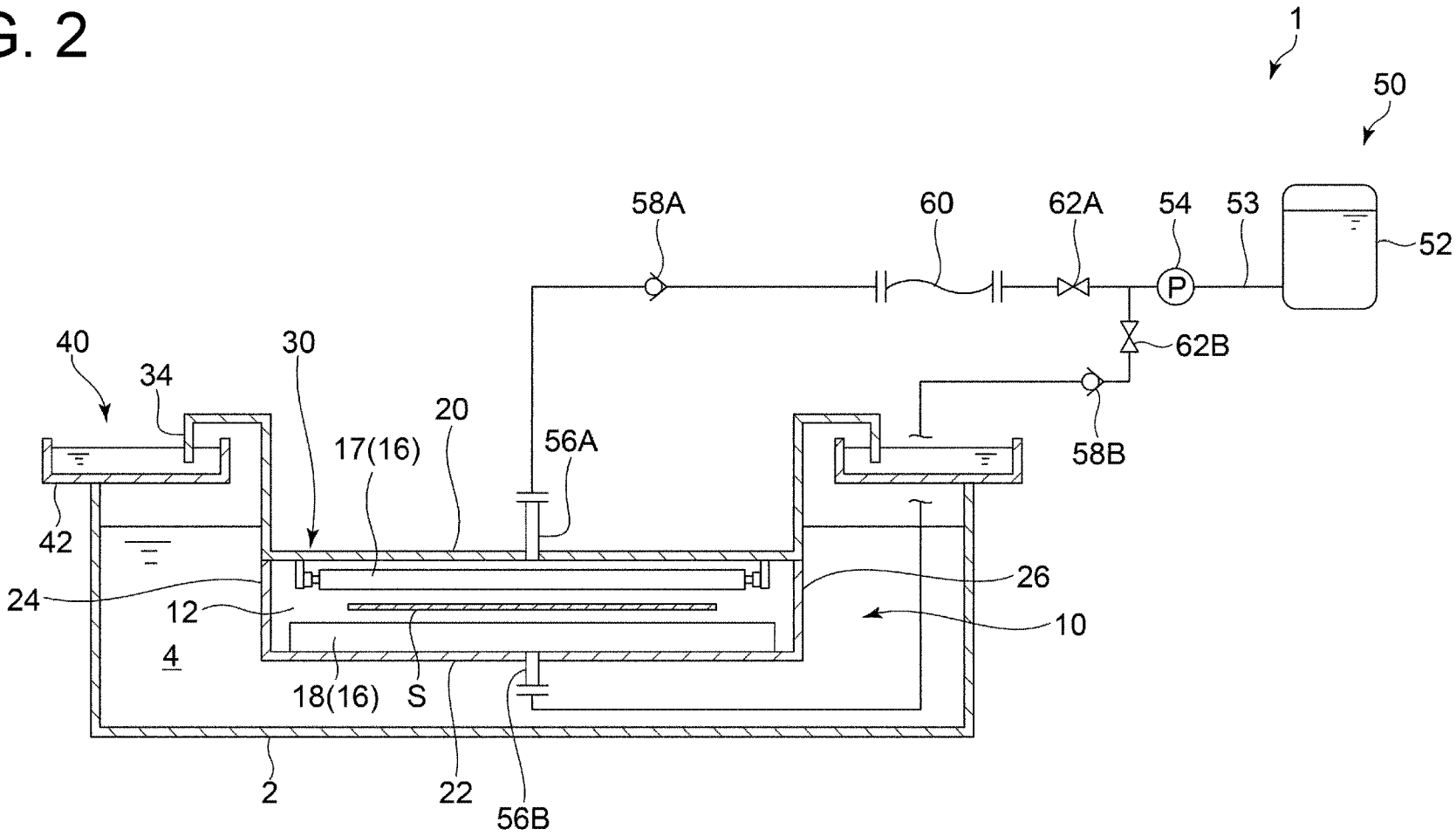
FIG. 2 is a schematic cross-sectional view of the pickling apparatus shown in FIG. 1.
Figure 3A:
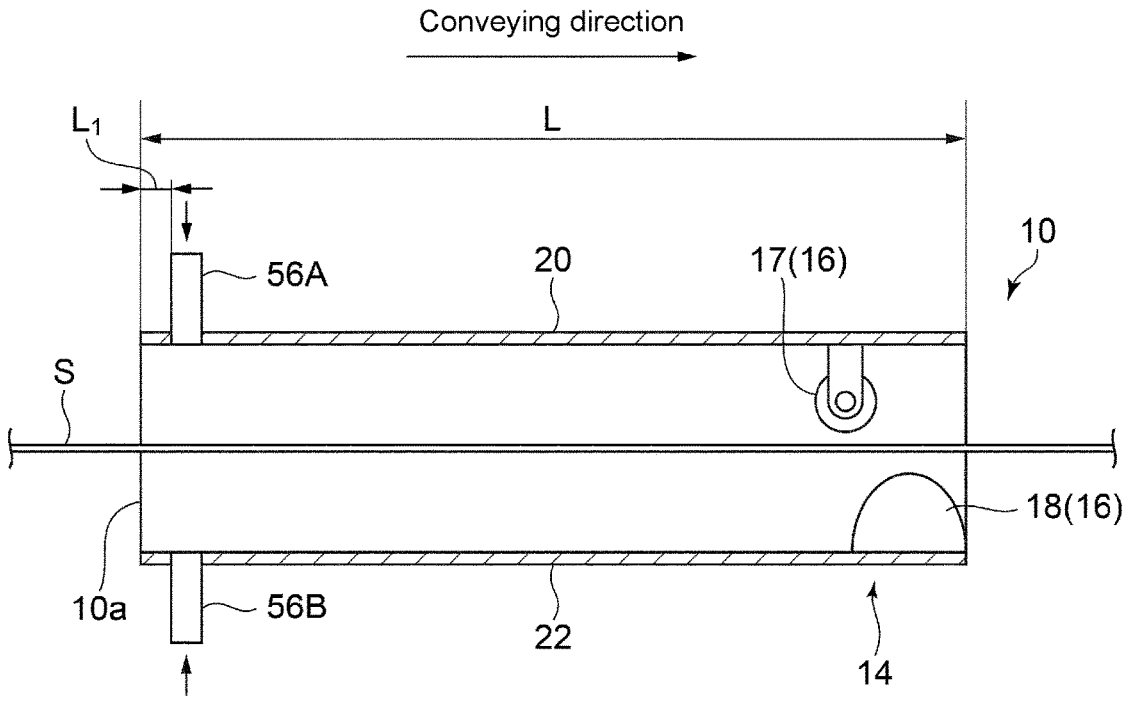
FIG. 3A is a schematic view of a surrounding part and an oxidant supply part of the pickling apparatus according to an embodiment.
Figure 3B:
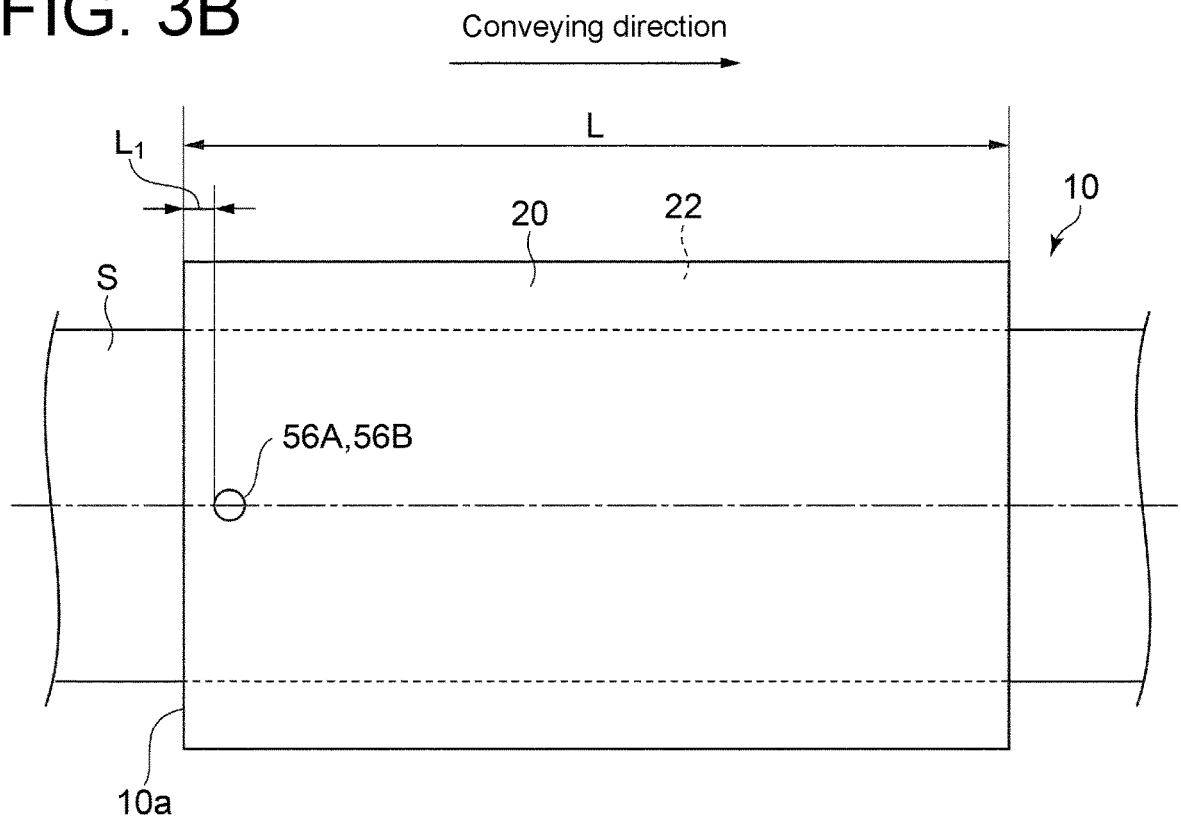
FIG. 3B is a schematic view of the surrounding part and the oxidant supply part of the pickling apparatus according to an embodiment.

FIG. 1 is a schematic configuration view of a pickling apparatus according to an embodiment. FIG. 2 is a schematic cross-sectional view of the pickling apparatus shown in FIG. 1.

A pickling apparatus 1 shown in FIG. 1 is a pickling apparatus for pickling a strip S of metal (for example, steel) by using an acid solution 4. As shown in FIG. 1, the pickling apparatus 1 includes a pickling tank 2 for storing the acid solution 4. The acid solution 4 is a pickling solution for dissolving and removing a scale (oxide layer) generated on the surface of the strip S and is, for example, a solution containing acid such as hydrochloric acid, sulfuric acid, nitric acid or hydrofluoric acid.

The pickling apparatus 1 shown in FIG. 1 includes a skid 8 and a conveyance roll 6 for conveying the strip S immersed in the acid solution 4, while guiding the strip S. The conveyance roll 6 may be configured to be driven by a motor (not shown) or the like to apply tension to the strip S and convey the strip S. The pickling apparatus 1 may be configured to convey the strip S by causing, with only catenary due to its own weight, the strip S to reach a depth at which the surrounding part is added, without including the conveyance roll 6.

The pickling apparatus 1 shown in FIG. 1 further includes a surrounding part 10 disposed in the pickling tank 2, and an oxidant supply part 50 for supplying a liquid oxidant toward an inside of the surrounding part 10.

The surrounding part 10 is disposed in the pickling tank 2 so as to surround the strip S immersed in the acid solution 4 in the pickling tank 2. The surrounding part 10 forms a passage 12 for the acid solution 4 along a conveying direction of the strip S (hereinafter, also simply referred to as the conveying direction).

As shown in FIG. 1, the pickling apparatus 1 may include a plurality of surrounding parts 10 disposed inside the pickling tank 2 and arranged in the conveying direction. In the exemplary embodiment shown in FIG. 1, four surrounding parts 10 are disposed inside the pickling tank 2.

In some embodiments, as shown in FIG. 2, the surrounding part 10 includes an upper plate part 20 and a lower plate part 22 disposed so as to respectively cover both faces of the strip S, and a pair of side plate parts 24, 26 disposed so as to connect the upper plate part 20 and the lower plate part 22 on both sides in a strip width direction of the strip S. The passage 12 for the acid solution 4 is formed by inner surfaces of the upper plate part 20, the lower plate part 22, and the side plate parts 24, 26.

In some embodiments, as shown in FIGS. 1 and 2, a guide part 16 for guiding the strip S being conveyed is disposed in the surrounding part 10. The guide part 16 may include a guide roll 17 or a receiving part 18 (such as a skid) disposed in the surrounding part 10. In the exemplary embodiments shown in FIGS. 1 and 2, the guide part 16 includes the guide roll 17 supported by the upper plate part 20 (surrounding part 10) and the receiving part 18 supported by the lower plate part 22 (surrounding part 10).

The oxidant supply part 50 is configured to supply a liquid oxidant for oxidizing $Fe^{2+}$ in the acid solution 4 to $Fe^{3+}$ toward the inside of the surrounding part 10. The oxidant supply part 50 shown in FIGS. 1 and 2 includes an oxidant tank 52 in which the liquid oxidant is stored, an oxidant supply line 53 for introducing the liquid oxidant from the oxidant tank 52 toward the inside of the surrounding part 10, and an oxidant pump 54 disposed on the oxidant supply line 53.

In the exemplary embodiments shown in FIGS. 1 and 2, the oxidant supply part 50 includes pipes 56 (56A, 56B) connected to the surrounding part 10 and is configured to supply the liquid oxidant into the surrounding part 10 via the pipes 56. In the exemplary embodiments shown in FIGS. 1 and 2, the pipe 56A is connected to the upper plate part 20 forming the surrounding part 10. Further, the pipe 56B is connected to the lower plate part 22 forming the surrounding part 10.

As the liquid oxidant, a liquid having the ability to oxidize ferrous ions ($Fe^{2+}$) can be used. The liquid oxidant may be, for example, a liquid containing at least one of hydrogen peroxide solution, hypochlorous acid, ammonium peroxodisulfate (ammonium persulfate), and potassium permanganate solution.

In the pickling apparatus 1 according to the above-described embodiments, since the liquid oxidant is supplied into the surrounding part 10 disposed so as to surround the strip S in the pickling tank 2, in the pickling tank 2, the liquid oxidant is prevented from being diffused to the outside of the surrounding part 10 and tends to remain in the vicinity of the strip S. Therefore, $Fe^{3+}$ produced by the reaction between the liquid oxidant and the acid solution 4 easily contacts the strip S, making it possible to efficiently perform pickling.

Further, in the surrounding part 10, a flow (entrained flow) of the acid solution entrained by the strip S being conveyed is formed, and the flow velocity of the acid solution 4 is relatively high. In this regard, in the above-described embodiments, since the liquid oxidant is supplied into the surrounding part 10, it is possible to increase a chance of contact between the liquid oxidant and $Fe^{2+}$ in the acid solution 4. Whereby, the oxidation reaction of $Fe^{2+}$ ($Fe^{3+}$ production reaction) by the liquid oxidant occurs easily, and it is possible to prevent the liquid oxidant from being wasted due to thermal decomposition or reaction with the acid in the acid solution.

This will be described using an example in which the acid solution 4 contains hydrochloric acid (HCl) and the liquid oxidant contains hydrogen peroxide solution ($H_2O_2$). That is, if the liquid oxidant is supplied to the acid solution 4 in the pickling tank 2, $Fe^{2+}$ contained in the acid solution 4 is oxidized according to the following reaction formula (A).

$$H_2O_2 + 2Fe^{2+} + 2HCl \rightarrow 2H_2O + 2Fe^{3+} + 2Cl^- \quad (A)$$

On the other hand, the liquid oxidant supplied to the acid solution 4 can also be consumed by a thermal decomposition reaction (reaction formula (B) below) or a reaction with the acid constituting the acid solution 4 (reaction formula (C) below).

$$2H_2O_2 \rightarrow 2H_2O + O_2 \quad (B)$$

$$H_2O_2 + 2HCl \rightarrow 2H_2O + Cl_2 \quad (C)$$

Herein, if the chance of contact between the liquid oxidant and $Fe^{2+}$ in the acid solution 4 increases, the oxidation reaction of $Fe^{2+}$ (reaction formula (A)) occurs relatively easily compared to the thermal decomposition of the liquid oxidant (reaction formula (B)) and the reaction with the acid (reaction formula (C)), and it is possible to prevent the liquid oxidant from being consumed without contributing to the oxidation reaction of $Fe^{2+}$ due to the reaction of reaction formula (B) or reaction formula (C).

Therefore, according to the above-described embodiments, the strip S can be pickled more efficiently.

As shown in FIGS. 1 and 2, the pickling apparatus 1 may include a lid part 30 covering the pickling tank 2 from above. A loss due to evaporation of the acid solution 4 in the pickling tank 2 can be suppressed by covering the pickling tank 2 from above with the lid part 30. Further, the pickling apparatus 1 may include a seal part 40 for sealing a space surrounded by the pickling tank 2 and the lid part 30. The loss due to evaporation of the acid solution 4 in the pickling tank 2 can more effectively be suppressed by providing such seal part 40.

As shown in FIG. 2, the lid part 30 may include the upper plate part 20 forming an upper portion of the surrounding part 10. Further, the lid part 30 may include the upper plate part 20, as well as may include a seal plate part 34 configured to be inserted from above into a tub part 42 disposed at an edge (upper end portion) of the pickling tank 2. The seal part 40 includes the tub part 42 and the seal plate part 34, and may be configured to seal, by immersing the seal plate part 34 in a seal liquid (water etc.) stored in the tub part 42, the space surrounded by the pickling tank 2 and the lid part 30.

In the exemplary embodiment shown in FIG. 2, the lid part 30 is disposed to be openable and closable integrally with the upper plate part 20 forming the surrounding part 10. The pickling apparatus 1 may include an actuator for opening and closing the lid part 30.

In some embodiments, the passage 12 formed by the surrounding part 10 has a passage decreasing part 14 located downstream of an upstream end 10*a* of the surrounding part 10 in the conveying direction and having a smaller passage cross-sectional area than the upstream end 10*a*. Herein, the passage cross-sectional area is an area of a passage cross-section of the passage 12 orthogonal to the conveying direction. The passage decreasing part 14 may be formed by the above-described guide part 16 disposed in the surrounding part 10. In the exemplary embodiments shown in FIGS. 1 and 2, the passage decreasing part 14 is formed by the guide roll 17 (guide part 16) and the receiving part 18 (guide part 16).

In the above-described embodiments, since the passage 12 formed by the surrounding part 10 has the passage decreasing part 14 located downstream of the upstream end 10*a* of the surrounding part 10, a reverse flow, which is obtained by reversing the entrained flow of the acid solution 4 entrained by the strip S, at the passage decreasing part 14 (the guide roll 17 or the receiving part 18) is formed in the surrounding part 10. Since the acid solution 4 is agitated by this reverse flow, it is possible to further increase the chance of contact between the liquid oxidant and $Fe^{2+}$ in the acid solution 4. Therefore, the oxidation reaction of $Fe^{2+}$ by the liquid oxidant occurs more easily, making it possible to more efficiently pickle the strip S.

FIGS. 3A to 8 are each a schematic view of the surrounding part 10 and the oxidant supply part 50 of the pickling apparatus according to an embodiment. FIGS. 3A, 4A, 5A, and 8 are cross-sectional views including the conveying direction and the up-down direction (vertical direction), and FIGS. 3B, 4B, and 5B are plan view corresponding to FIGS. 3A, 4A, and 5A, respectively. Further, FIGS. 6A and 7A are front views, and FIGS. 6B and 7B are cross-sectional views along the horizontal direction corresponding to FIGS. 6A and 7A, respectively.

In the exemplary embodiments shown in FIGS. 3A to 7B, the oxidant supply part 50 includes the pipes 56 (56A to 56D) connected to the surrounding part 10. The pipe 56 may be disposed so as to penetrate the member (the upper plate part 20, the lower plate part 22, the side plate parts 24, 26, or the like) forming the surrounding part 10. The pipe 56 may be supported by the pickling tank 2 or the lid part 30. The liquid oxidant is supplied to the inside of the surrounding part 10 via the pipe 56.

Figure 8:
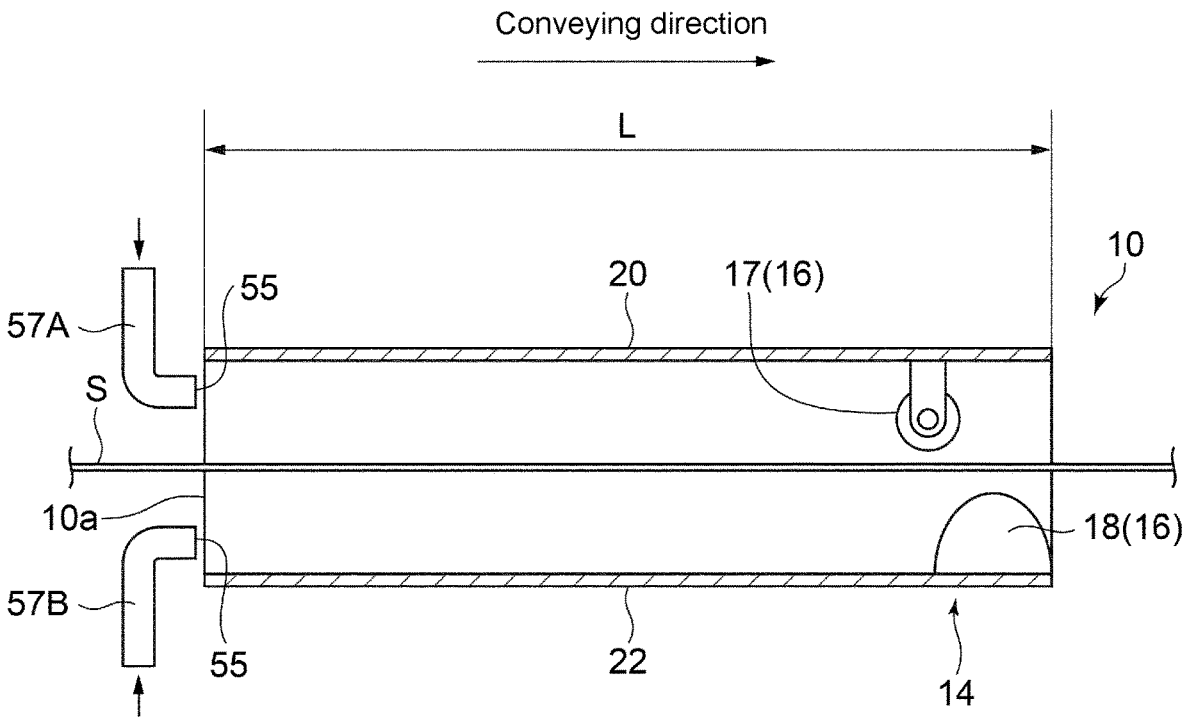
FIG. 8 is a schematic view of the surrounding part and the oxidant supply part of the pickling apparatus according to an embodiment.

In the exemplary embodiment shown in FIG. 8, the oxidant supply part 50 includes a nozzle 57 (57A, 57B) disposed at least partially upstream of the surrounding part 10 in the conveying direction. The liquid oxidant is ejected from an opening 55 of the nozzle 57 and is supplied to the inside of the surrounding part 10. As shown in FIG. 8, the opening 55 of the nozzle 57 may be located upstream of the upstream end 10*a* of the surrounding part 10 in the conveying direction, or may be located downstream of the upstream end 10*a*, or may be at the same position as the upstream end 10*a*.

In some embodiments, the oxidant supply part 50 may include the pipe 56A connected to the upper plate part 20, or may include the pipe 56B connected to the lower plate part 22. In the exemplary embodiments shown in FIGS. 3A to 5B, the oxidant supply part 50 includes the pipe 56A connected to the upper plate part 20 and the pipe 56B connected to the lower plate part 22.

In some embodiments, the oxidant supply part 50 may include the pipe 56C or the pipe 56D connected to at least either of the side plate part 24 or 26. In the exemplary embodiments shown in FIGS. 6A to 7B, the oxidant supply part 50 includes the pipe 56C and the pipe 56D respectively connected to the side plate parts 24, 26.

As shown in FIGS. 5A to 8, the oxidant supply part 50 may be configured to supply the liquid oxidant at a position upstream of the passage decreasing part 14 in the conveying direction. In the exemplary embodiments shown in FIGS. 5A to 8, the liquid oxidant is supplied at the position upstream of the passage decreasing part 14 in the conveying direction via the pipe 56 or the nozzle 57 (oxidant supply part 50) connected to the surrounding part 10 at the position upstream of the guide roll 17 and the receiving part 18, which form the passage decreasing part 14, in the conveying direction.

Since the liquid oxidant is thus supplied at the position upstream of the passage decreasing part 14, the acid solution 4 containing the liquid oxidant is agitated by the reverse flow formed at the passage decreasing part 14. Therefore, the chance of contact between the liquid oxidant and $Fe^{2+}$ in the acid solution 4 increases and the oxidation reaction of $Fe^{2+}$ occurs easily, making it possible to more efficiently pickle the strip S.

In some embodiments, for example, as shown in FIGS. 3A to 4B, and FIGS. 6A and 6B, the oxidant supply part 50 may be configured to supply the liquid oxidant at a position where a length from the upstream end 10*a* of the surrounding part 10 is at least 0 and at most L/2, where L is a length of the surrounding part 10 in the conveying direction.

By thus supplying the liquid oxidant at the relatively upstream position where the length from the upstream end 10*a* of the surrounding part 10 is at least 0 and at most L/2, the liquid oxidant supplied into the surrounding part 10 diffuses into the acid solution 4 while traveling a relatively long distance which is not less than half the length of the surrounding part 10 inside the surrounding part 10, it is possible to increase the chance of contact between the liquid oxidant and $Fe^{2+}$ in the acid solution 4.

Figure 4A:
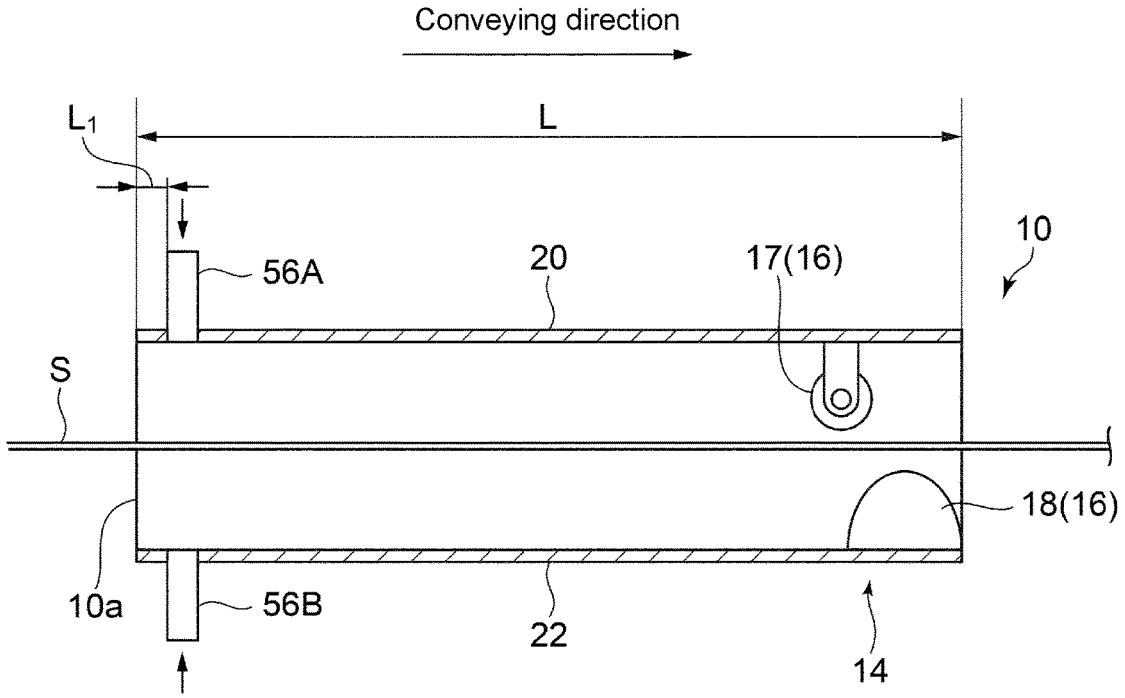
FIG. 4A is a schematic view of the surrounding part and the oxidant supply part of the pickling apparatus according to an embodiment.
Figure 4B:
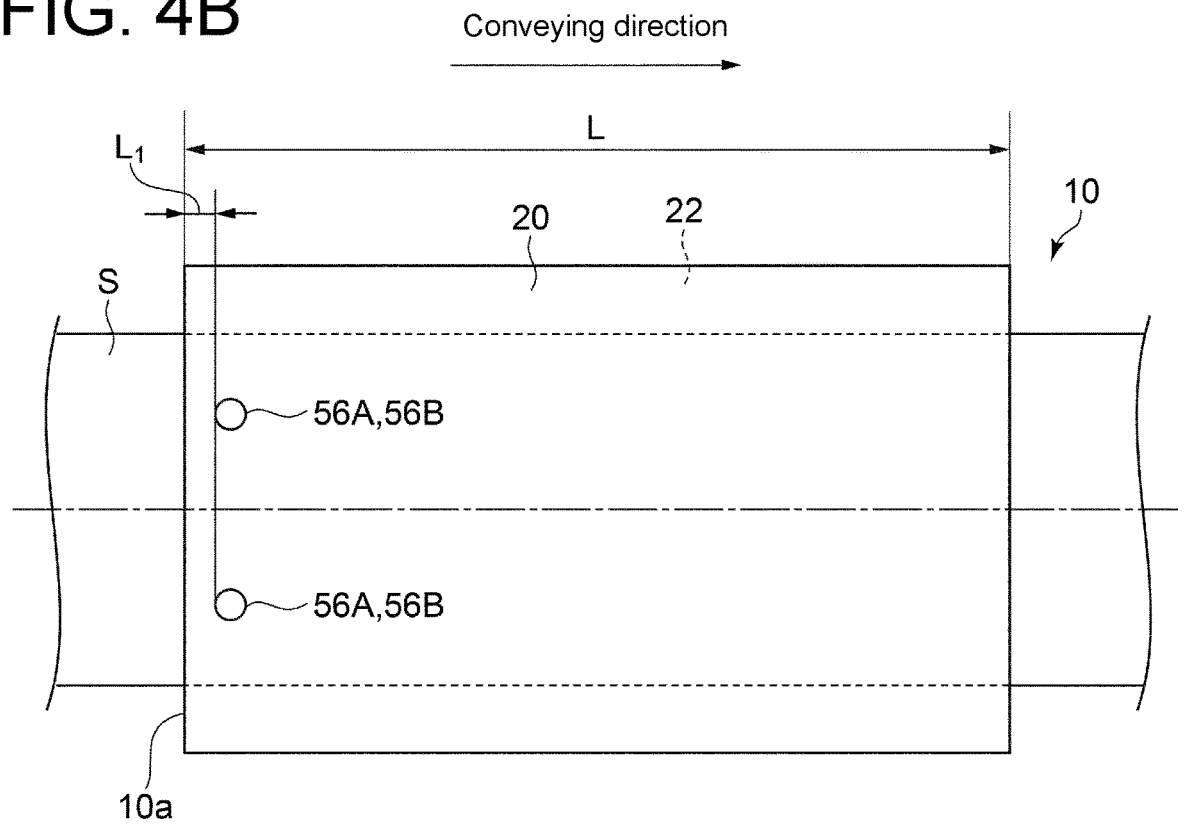
FIG. 4B is a schematic view of the surrounding part and the oxidant supply part of the pickling apparatus according to an embodiment.
Figure 5A:
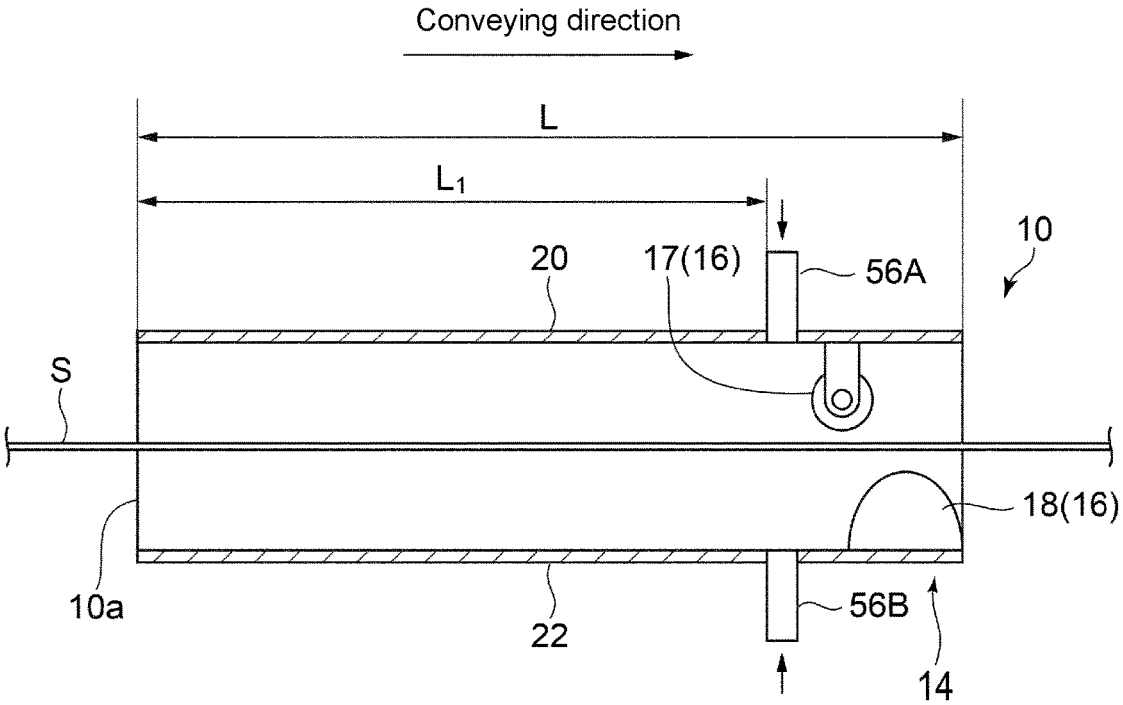
FIG. 5A is a schematic view of the surrounding part and the oxidant supply part of the pickling apparatus according to an embodiment.
Figure 5B:
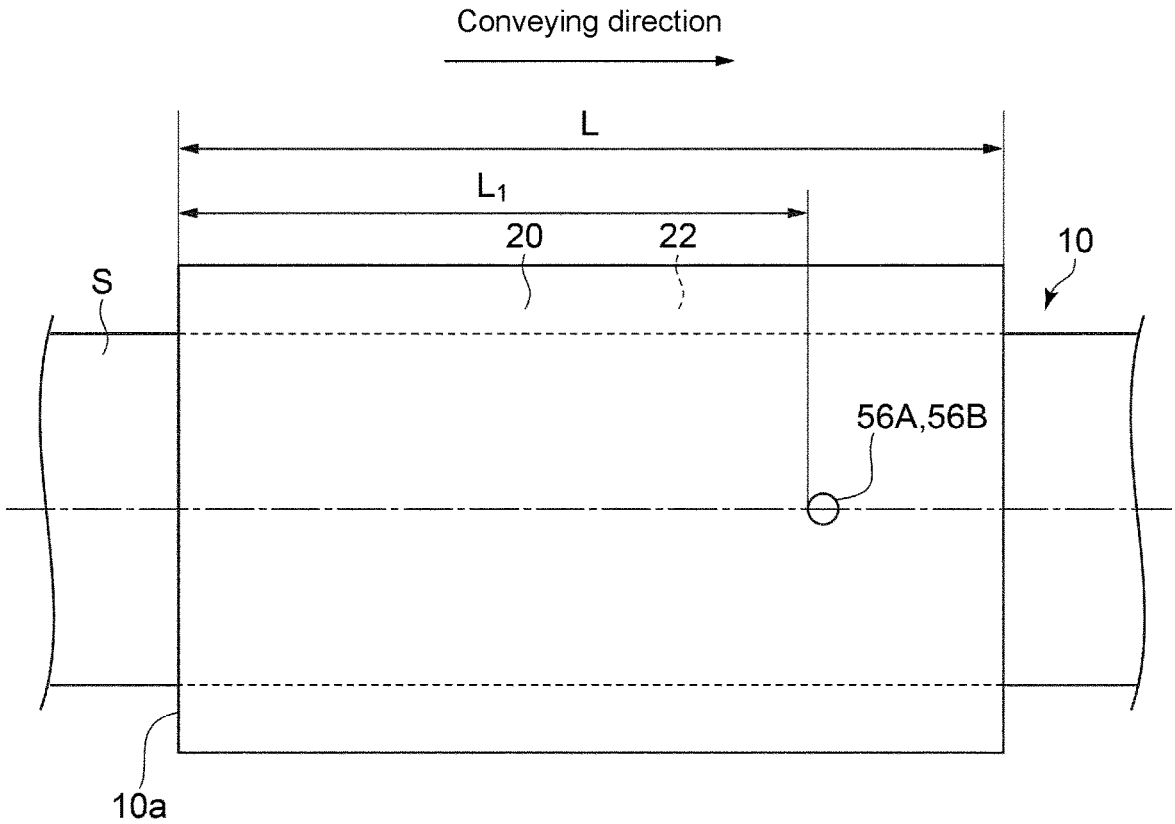
FIG. 5B is a schematic view of the surrounding part and the oxidant supply part of the pickling apparatus according to an embodiment.
Figure 6A:
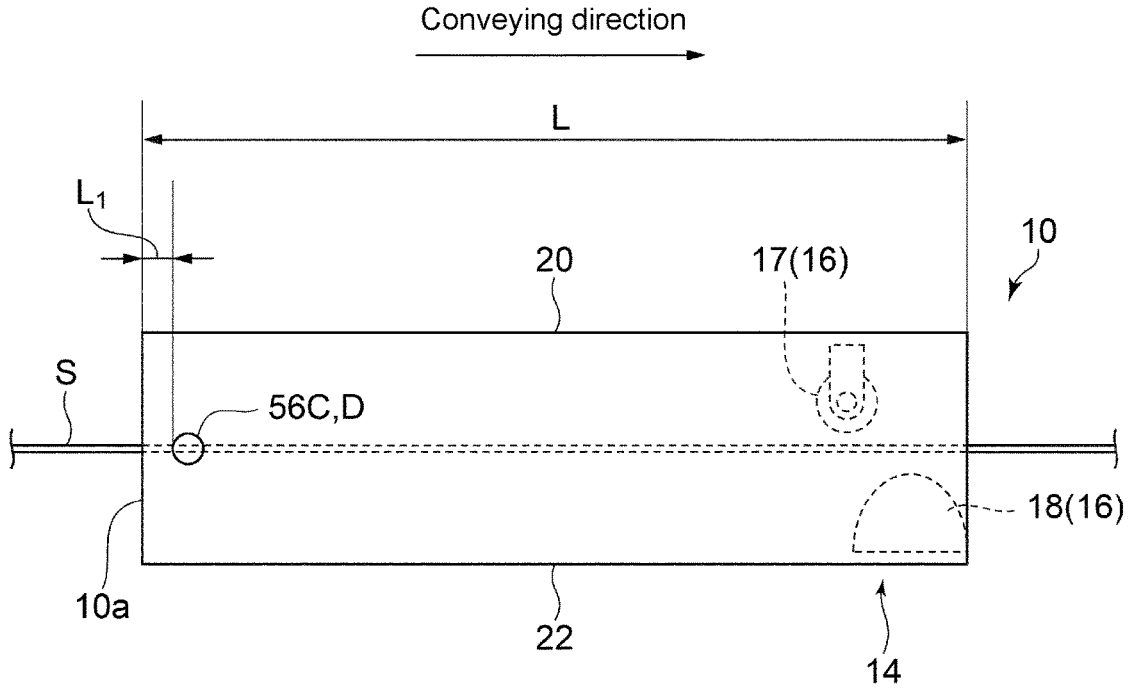
FIG. 6A is a schematic view of the surrounding part and the oxidant supply part of the pickling apparatus according to an embodiment.
Figure 6B:
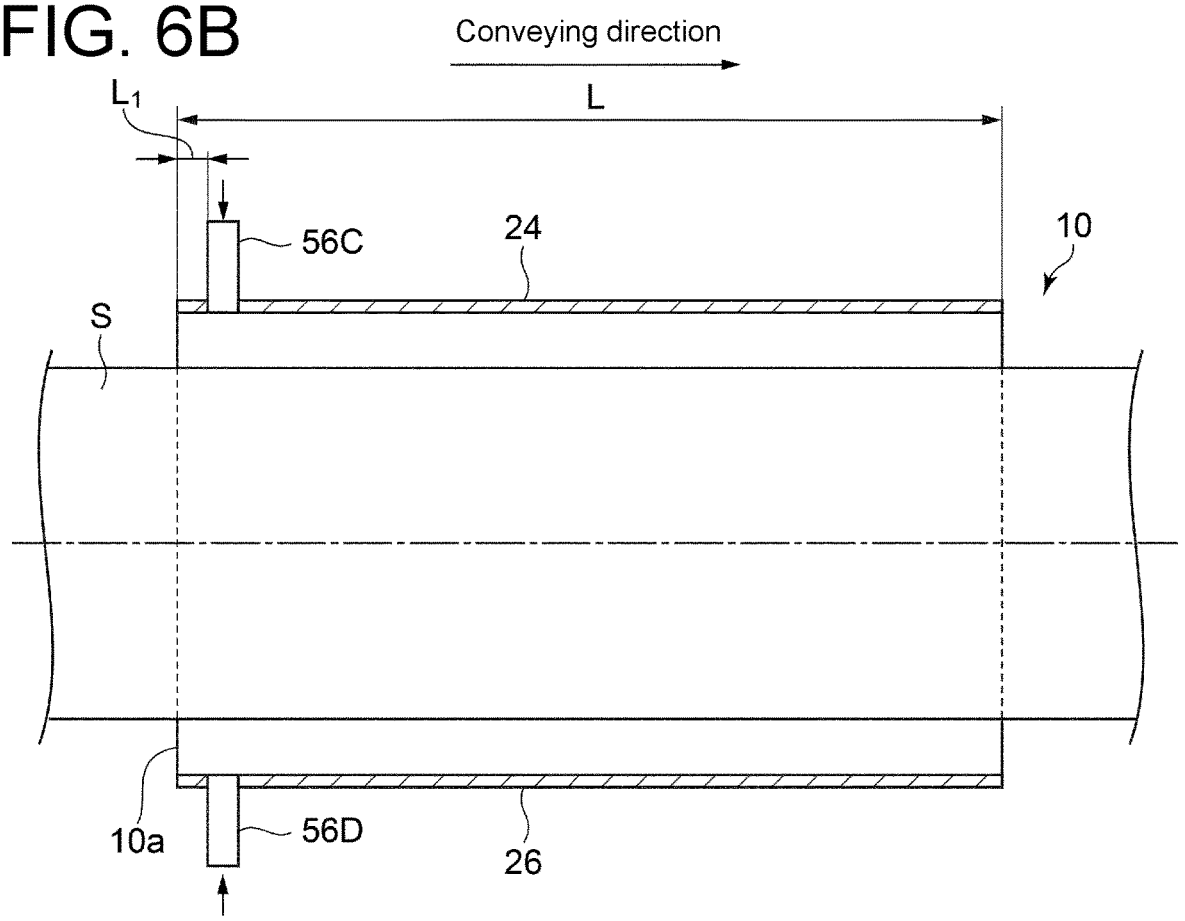
FIG. 6B is a schematic view of the surrounding part and the oxidant supply part of the pickling apparatus according to an embodiment.
Figure 7A:
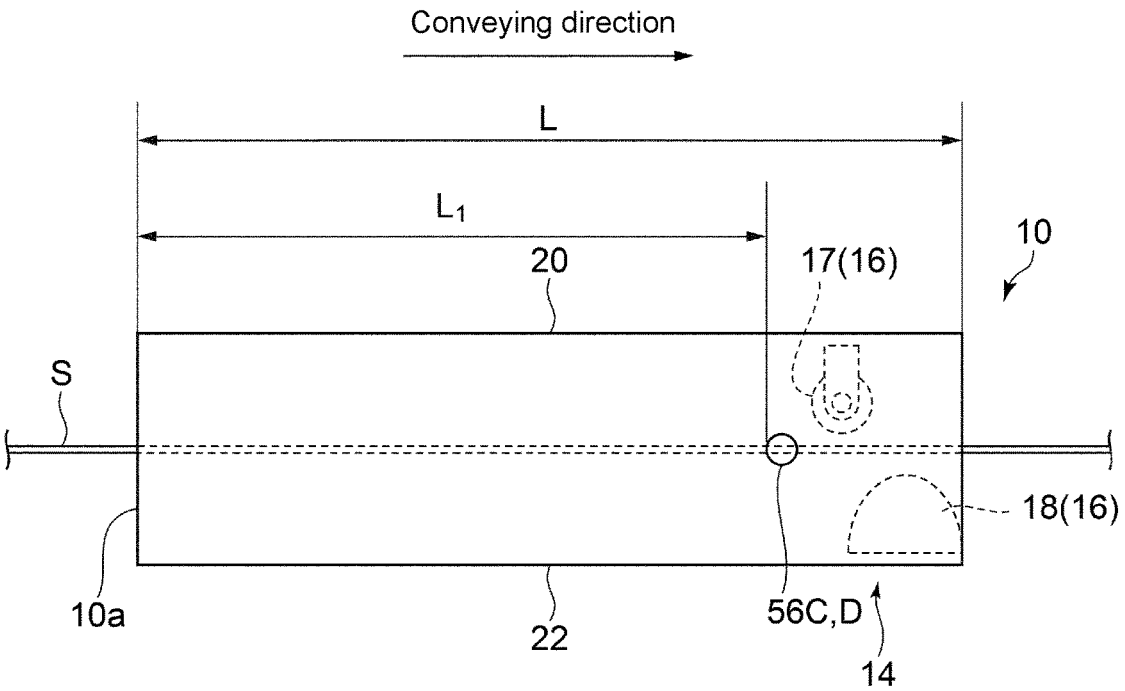
FIG. 7A is a schematic view of the surrounding part and the oxidant supply part of the pickling apparatus according to an embodiment.
Figure 7B:
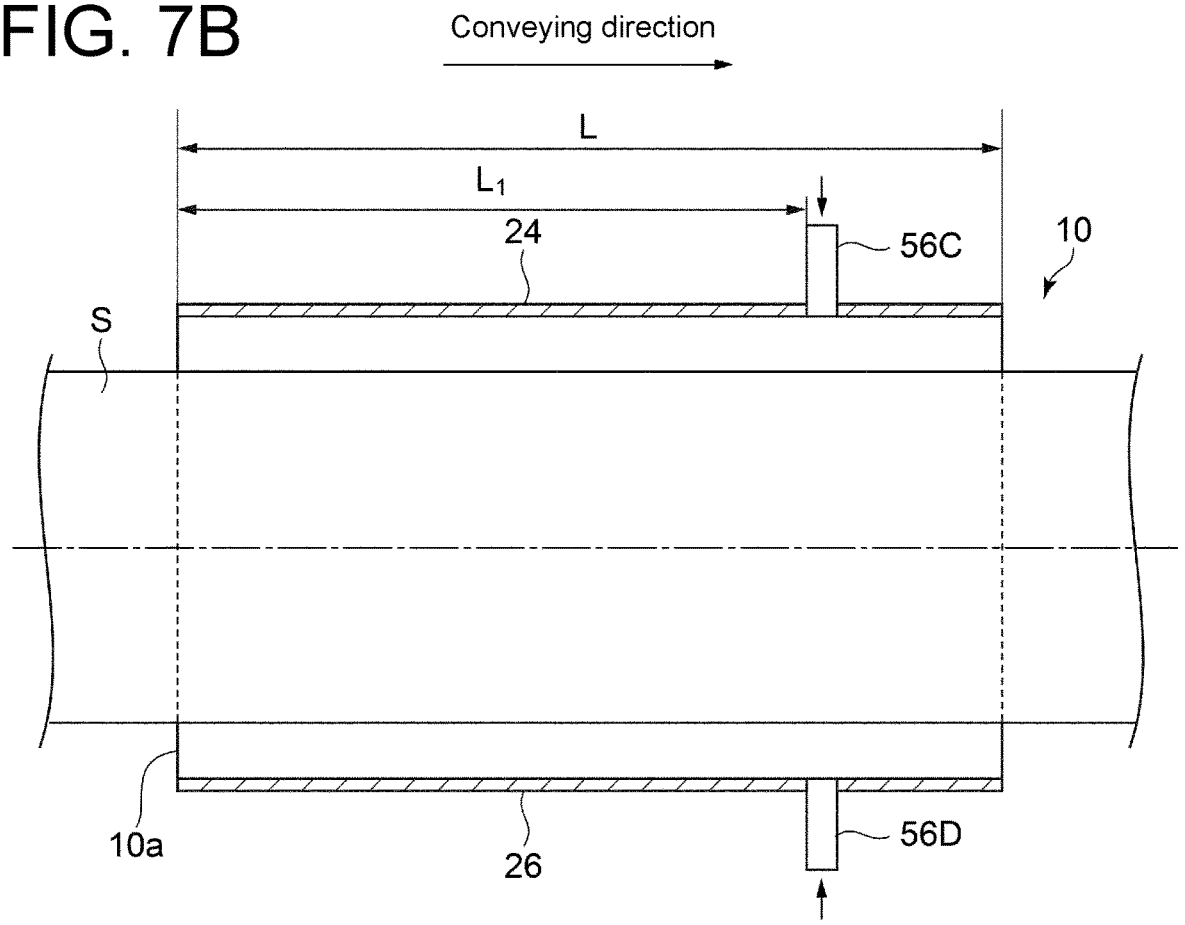
FIG. 7B is a schematic view of the surrounding part and the oxidant supply part of the pickling apparatus according to an embodiment.

In some embodiments, for example, as shown in FIGS. 4A and 4B, the oxidant supply part 50 may include a plurality of pipes 56 connected to the surrounding part 10 at mutually different positions in the strip width direction of the strip S. In the exemplary embodiments shown in FIGS. 4A and 4B, the oxidant supply part 50 includes a plurality of pipes 56A connected to the upper plate part 20 (surrounding part 10) at the mutually different positions in the strip width direction of the strip S, and a plurality of pipes 56B connected to the lower plate part 22 (surrounding part 10) at the mutually different positions in the strip width direction of the strip S.

In the surrounding part 10, the acid solution 4 mainly flows in the conveying direction of the strip S (that is, the longitudinal direction of the strip S), and thus the diffusion rate of the liquid oxidant, which is supplied to the inside of the surrounding part 10, in the strip width direction is lower than the diffusion rate in the conveying direction. According to the above-described embodiments, since the liquid supply agent is supplied into the surrounding part 10 via the plurality of pipes 56 disposed at the mutually different positions in the strip width direction, the concentration of the liquid oxidant is easily equalized in the strip width direction where the diffusion rate of the liquid oxidant is low. Therefore, uniform pickling is easily performed in the strip width direction. In the surrounding part 10, the acid solution is entrained by the strip S and mainly flows in the conveying direction of the strip S (that is, the longitudinal direction of the strip S), but on a lower side of the lower plate part 22 of the surrounding part 10 and on both outer sides of the two side plate parts 24, 26 of the surrounding part 10, the acid solution tends to mainly flow in a direction opposite to the conveying direction of the strip S. Further, by positioning the lid part 30 such that the upper plate part 10 of the lid part 30 is below a free liquid level of the acid solution, the lid part 30 reduces the area of the free liquid level of the acid solution, and thus energy entraining the acid solution created by the traveling of the strip is used for the flux of the acid solution without being consumed by vertical movement of the free liquid level etc., and the energy is efficiently converted into the flow of the acid solution.

In some embodiments, for example, as shown in FIG. 2, the pipe 56 (oxidant supply part 50) connected to the surrounding part 10 may be provided with check valves 58 (58A, 58B). In the exemplary embodiment shown in FIG. 2, the check valve 58A is disposed in the pipe 56A connected to the upper plate part 20 (surrounding part 10). Further, the check valve 58B is disposed in the pipe 56B connected to the lower plate part 22 (surrounding part 10). In FIG. 2, the oxidant supply line 53 is provided with valves 62A, 62B for adjusting the amount of the liquid oxidant supplied from the oxidant tank 52 into the surrounding part 10.

According to the above-described embodiment, since the check valve 58 is disposed in the pipe 56 for supplying the liquid oxidant, it is possible to prevent the acid solution from entering the oxidant supply line 53 for some reason (for example, due to a decrease in supply pressure of the liquid oxidant, etc.)

In some embodiments, for example, as shown in FIG. 2, a flexible hose 60 may be disposed on the oxidant supply line 53 between the oxidant tank 52 and the pipe 56A connected to the upper plate part 20.

In the above-described embodiment, since the flexible hose 60 is disposed on the oxidant supply line 53 between the oxidant tank 52 and the pipe 56A connected to the upper plate part 20, the upper plate part 20 of the surrounding part 10 can smoothly be opened and closed together with the lid part 30 while maintaining the state where the surrounding part 10 and the oxidant tank 52 are connected via the pipe 56A and the flexible hose 60. Therefore, it is possible to easily perform inspection or maintenance of the inside of the pickling tank 2 and the surrounding part 10.

In some embodiments, for example, as shown in FIG. 2, the flexible hose 60 may be disposed upstream (on the oxidant tank 52 side) of the check valve 58 on the oxidant supply line 53.

Since the flexible hose 60 is thus disposed upstream of the check valve 58, it is possible to prevent the acid solution from entering the flexible hose 60 and it is possible to protect the flexible hose 60 from, for example, corrosion caused by acid.

Figure 9:
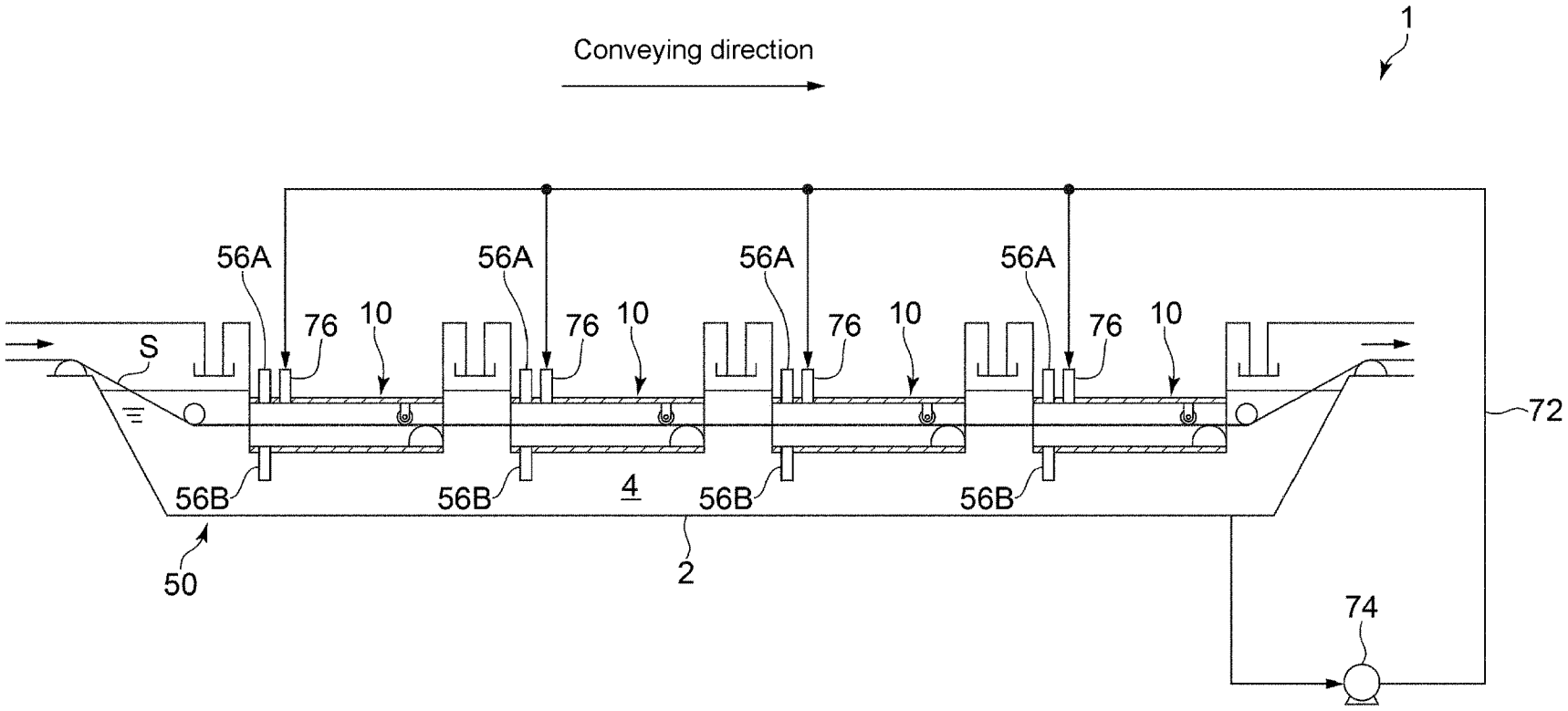
FIG. 9 is a schematic configuration view of the pickling apparatus according to an embodiment.
Figure 10:
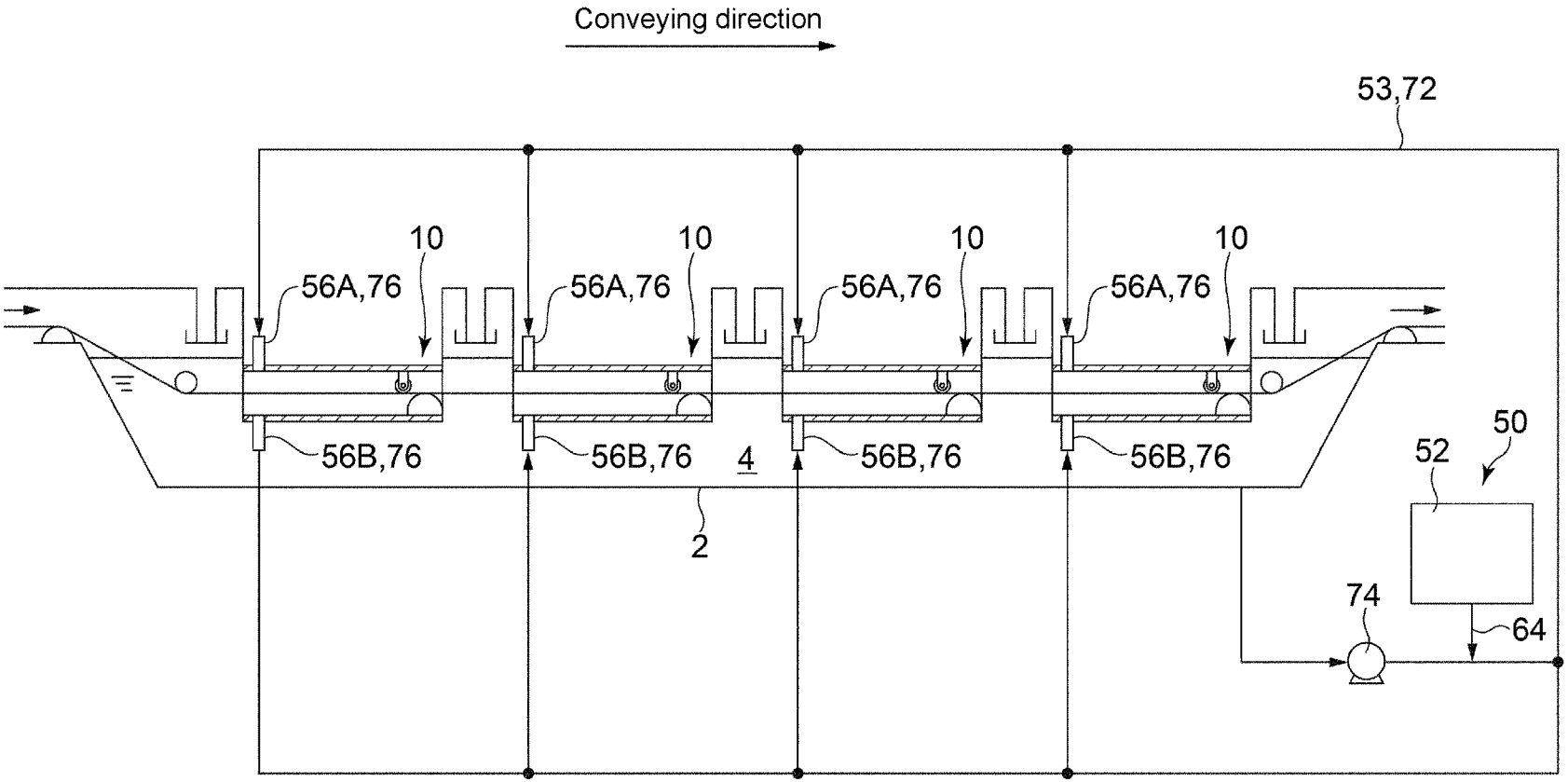
FIG. 10 is a schematic configuration view of the pickling apparatus according to an embodiment.

FIGS. 9 and 10 are respectively a schematic configuration view of the pickling apparatus according to an embodiment and a schematic configuration view of the pickling apparatus according to an embodiment.

In the exemplary embodiments shown in FIGS. 9 and 10, as with the pickling apparatus 1 shown in FIG. 1, the pickling apparatus 1 includes the pickling tank 2 for storing the acid solution 4, the surrounding part 10 disposed in the pickling tank 2, and the oxidant supply part 50 for supplying the liquid oxidant toward the inside of the surrounding part 10.

In the exemplary embodiments shown in FIGS. 9 and 10, the pickling apparatus 1 further includes an acid solution circulation line 72 configured to extract the acid solution 4 from the pickling tank 2 and return the acid solution 4 toward the inside of the surrounding part 10 in the pickling tank 2. The acid solution circulation line 72 is provided with an acid solution circulation pump 74. The acid solution 4 extracted from the pickling tank 2 is supplied to the inside of the surrounding part 10 via the acid solution circulation line 72 and a pipe 76 connected to the surrounding part 10.

According to the above-described embodiments, since the acid solution 4 extracted from the pickling tank 2 is returned toward the inside of the surrounding part 10 via the acid solution circulation line 72, it is possible to promote the agitation of the acid solution 4 inside the surrounding part 10. Therefore, the chance of contact between the liquid oxidant supplied toward the inside of the surrounding part 10 and $Fe^{2+}$ in the acid solution 4 increases and the oxidation reaction of $Fe^{2+}$ occurs easily, making it possible to more efficiently pickle the strip S.

In some embodiments, for example, as shown in FIG. 10, the oxidant supply part 50 may include a pipe 64 connected to the acid solution circulation line 72, and may be configured to supply the liquid oxidant toward the inside of the surrounding part 10 via the acid solution circulation line 72. In the exemplary embodiment shown in FIG. 10, the oxidant supply part 50 includes the pipe 64 connecting the oxidant tank 52 and the acid solution circulation line 72. Further, in the exemplary embodiment shown in FIG. 10, the pipe 76 connected to the surrounding part 10 and configured to return the acid solution 4 from the acid solution circulation line 72 to the inside of the surrounding part 10 also functions as the pipe 56 for supplying the liquid oxidant to the inside of the surrounding part 10. Furthermore, a portion of the acid solution circulation line 72 on the downstream side of the connection portion with the pipe 64 functions as the oxidant supply line 53.

According to the above-described embodiments, since the liquid oxidant is mixed into the acid solution 4 via the pipe 64 connected to the acid solution circulation line 72, the liquid oxidant can be supplied toward the inside of the surrounding part 10 with the relatively simple configuration.

Hereinafter, the overview of the pickling apparatus and the pickling method according to some embodiments will be described.

(1) A pickling apparatus (1) according to at least one embodiment of the present invention is a pickling apparatus for pickling a strip (S) of metal being conveyed, including: a pickling tank (2) for storing an acid solution (4); a surrounding part (10) disposed in the pickling tank so as to surround the strip immersed in the acid solution in the pickling tank; and an oxidant supply part (50) for supplying a liquid oxidant toward an inside of the surrounding part.

In the above configuration (1), since the liquid oxidant is supplied into the surrounding part disposed so as to surround the strip in the pickling tank, in the pickling tank, the liquid oxidant is prevented from being diffused to the outside of the surrounding part and tends to remain in the vicinity of the strip. Therefore, $Fe^{3+}$ produced by the reaction between the liquid oxidant and the acid solution easily contacts the strip, making it possible to efficiently perform pickling.

Further, in the surrounding part, a flow (entrained flow) of the acid solution entrained by the strip being conveyed is formed, and the flow velocity of the acid solution is relatively high. In this regard, in the above configuration (1), since the liquid oxidant is supplied into the surrounding part, it is possible to increase the chance of contact between the liquid oxidant and $Fe^{2+}$ in the acid solution. Whereby, the oxidation reaction of $Fe^{2+}$ ($Fe^{3+}$ production reaction) by the liquid oxidant occurs easily, and it is possible to prevent the liquid oxidant from being wasted due to thermal decomposition or reaction with the acid in the acid solution.

Therefore, according to the above configuration (1), the strip can be pickled more efficiently.

(2) In some embodiments, in the above configuration (1), the surrounding part forms a passage (12) for the acid solution along a conveying direction of the strip, and the passage has a passage decreasing part located downstream of an upstream end (10*a*) of the surrounding part in the conveying direction and having a smaller passage cross-sectional area than the upstream end.

According to the above configuration (2), since the passage formed by the surrounding part has the passage decreasing part located downstream of the upstream end, a reverse flow, which is obtained by reversing the entrained flow of the acid solution described above, at the passage decreasing part is formed in the surrounding part. Since the acid solution is agitated by this reverse flow, it is possible to further increase the chance of contact between the liquid oxidant and $Fe^{2+}$ in the acid solution. Therefore, the oxidation reaction of $Fe^{2+}$ by the liquid oxidant occurs more easily, making it possible to more efficiently pickle the strip.

(3) In some embodiments, in the above configuration (2), the pickling apparatus includes: a guide part (16) disposed in the surrounding part and configured to guide the strip. The passage decreasing part is formed by the guide part.

According to the above configuration (3), since the passage decreasing part is formed using the guide part disposed in the surrounding part, it is possible to achieve efficient pickling of the strip with the simple configuration.

(4) In some embodiments, in the above configuration (2) or (3), the oxidant supply part is configured to supply the liquid oxidant at a position upstream of the passage decreasing part in the conveying direction.

According to the above configuration (4), since the liquid oxidant is supplied at the position upstream of the passage decreasing part, the acid solution containing the liquid oxidant is agitated by the reverse flow formed at the passage decreasing part. Therefore, the chance of contact between the liquid oxidant and $Fe^{2+}$ in the acid solution increases and the oxidation reaction of $Fe^{2+}$ occurs easily, making it possible to more efficiently pickle the strip.

(5) In some embodiments, in any of the above configurations (1) to (4), the oxidant supply part is configured to supply the liquid oxidant at a position where a length from an upstream end of the surrounding part is at least 0 and at most L/2, where L is a length of the surrounding part in the conveying direction.

According to the above configuration (5), since the liquid oxidant is supplied at the relatively upstream position where the length from the upstream end of the surrounding part is at least 0 and at most L/2, the liquid oxidant supplied into the surrounding part diffuses into the acid solution while traveling a relatively long distance which is not less than half the length of the surrounding part inside the surrounding part, it is possible to increase the chance of contact between the liquid oxidant and $Fe^{2+}$ in the acid solution.

(6) In some embodiments, in any of the above configurations (1) to (5), the oxidant supply part includes at least one pipe (56) connected to the surrounding part and is configured to supply the liquid oxidant into the surrounding part via the pipe.

According to the above configuration (6), by supplying the liquid oxidant into the surrounding part via the pipe connected to the surrounding part, the strip can be pickled more efficiently as described in the above (1).

(7) In some embodiments, in the above configuration (6), the at least one pipe includes a plurality of pipes connected to the surrounding part at mutually different positions in a strip width direction of the strip.

In the surrounding part, the acid solution mainly flows in the conveying direction of the strip (that is, the longitudinal direction of the strip), and thus the diffusion rate of the liquid oxidant, which is supplied to the inside of the surrounding part, in the strip width direction is lower than the diffusion rate in the conveying direction. According to the above configuration (7), since the liquid supply agent is supplied into the surrounding part via the plurality of pipes disposed at the mutually different positions in the strip width direction, the concentration of the liquid oxidant is easily equalized in the strip width direction where the diffusion rate of the liquid oxidant is low. Therefore, uniform pickling is easily performed in the strip width direction.

(8) In some embodiments, in the above configuration (1), the pickling apparatus includes: a check valve (58) disposed in the at least one pipe.

According to the above configuration (8), since the check valve is disposed in the pipe for supplying the liquid oxidant, it is possible to prevent the acid solution from entering the liquid oxidant supply line for some reason.

(9) In some embodiments, in any of the above configurations (1) to (8), the surrounding part includes an upper plate part (20) and a lower plate part (22) disposed so as to cover both faces of the strip, and a pair of side plate parts (24, 26) disposed so as to connect the upper plate part and the lower plate part on both sides of the strip.

According to the above configuration (9), with the surrounding part of the simple configuration including the upper plate part, the lower plate part, and the pair of side plate parts, the strip can be pickled more efficiently as described in the above (1).

(10) In some embodiments, in the above configuration (9), the oxidant supply part includes a pipe (56A, 56B) penetrating at least either of the upper plate part or the lower plate part.

According to the above configuration (10), the liquid oxidant can be supplied from above or below the strip inside the surrounding part via the pipe connected to the upper plate part or the lower plate part. Whereby, the strip can be pickled more efficiently as described above in (1).

(11) In some embodiments, in the above configuration (9) or (10), the oxidant supply part includes a pipe (56C, 56D) penetrating at least either of the pair of side plate parts.

According to the above configuration (11), the liquid oxidant can be supplied from the side of the strip inside the surrounding part via the pipe connected to at least either of the pair of side plate parts. Whereby, the strip can be pickled more efficiently as described above in (1).

(12) In some embodiments, in any of the above configurations (9) to (11), the pickling apparatus includes: a lid part (30) covering the pickling tank from above. The lid part is disposed to be openable and closable integrally with the upper plate part. The oxidant supply part includes: an oxidant tank (52) for storing the liquid oxidant; a pipe (56A) connected to the upper plate part; and a flexible hose (60) disposed between the oxidant tank and the pipe.

According to the above configuration (12), since the flexible hose is disposed between the oxidant tank and the pipe connected to the upper plate part, the upper plate part of the surrounding part can smoothly be opened and closed together with the lid part while maintaining the state where the surrounding part and the oxidant tank are connected via the pipe and the flexible hose.

(13) In some embodiments, in any of the above configurations (1) to (12), the pickling apparatus includes: an acid solution circulation line (72) configured to extract the acid solution from the pickling tank and return the acid solution toward the inside of the surrounding part in the pickling tank.

According to the above configuration (13), since the acid solution is returned toward the inside of the surrounding part via the acid solution circulation line, it is possible to promote the agitation of the acid solution inside the surrounding part. Therefore, the chance of contact between the liquid oxidant supplied toward the inside of the surrounding part and $Fe^{2+}$ in the acid solution increases and the oxidation reaction of $Fe^{2+}$ occurs easily, making it possible to more efficiently pickle the strip.

(14) In some embodiments, in the above configuration (13), the oxidant supply part includes a pipe (64) connected to the acid solution circulation line, and is configured to supply the liquid oxidant toward the inside of the surrounding part via the acid solution circulation line.

According to the above configuration (14), since the liquid oxidant is mixed into the acid solution via the pipe connected to the acid solution circulation line, the above configuration (1) can be realized with the relatively simple configuration.

(15) A pickling method according to at least one embodiment of the present invention is a pickling method for pickling a strip of metal being conveyed, including: a step of conveying the strip in a state where the strip is immersed in an acid solution stored in a pickling tank and the strip is surrounded by a surrounding part disposed in the pickling tank; and a step of supplying a liquid oxidant toward an inside of the surrounding part.

According to the above method (15), since the liquid oxidant is supplied into the surrounding part disposed so as to surround the strip in the pickling tank, in the pickling tank, the liquid oxidant is prevented from being diffused to the outside of the surrounding part and tends to remain in the vicinity of the strip. Therefore, $Fe^{3+}$ produced by the reaction between the liquid oxidant and the acid solution easily contacts the strip, making it possible to efficiently perform pickling.

Further, in the surrounding part, a flow (entrained flow) of the acid solution entrained by the strip being conveyed is formed, and the flow velocity of the acid solution is relatively high. In this regard, in the above method (15), since the liquid oxidant is supplied into the surrounding part, it is possible to increase the chance of contact between the liquid oxidant and $Fe^{2+}$ in the acid solution. Whereby, the oxidation reaction of $Fe^{2+}$ ($Fe^{3+}$ production reaction) by the liquid oxidant occurs easily, and it is possible to prevent the liquid oxidant from being wasted due to thermal decomposition or reaction with the acid in the acid solution.

Therefore, according to the above method (15), the strip can be pickled more efficiently.

Embodiments of the present invention were described in detail above, but the present invention is not limited thereto, and also includes an embodiment obtained by modifying the above-described embodiments and an embodiment obtained by combining these embodiments as appropriate.

Further, in the present specification, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same" "equal" and "uniform" shall not be construed as indicating only the state in which the feature is strictly equal, but also includes a state in which there is a tolerance or a difference that can still achieve the same function.

Further, an expression of a shape such as a rectangular shape or a cylindrical shape shall not be construed as only the geometrically strict shape, but also includes a shape with unevenness or chamfered corners within the range in which the same effect can be achieved.

As used herein, the expressions "comprising", "including" or "having" one constitutional element is not an exclusive expression that excludes the presence of other constitutional elements.

REFERENCE SIGNS LIST

1 Pickling apparatus
2 Pickling tank
4 Acid solution
6 Conveyance roll
8 Skid
10 Surrounding part
10*a* Upstream end
12 Passage
14 Passage decreasing part
16 Guide part
17 Guide roll
18 Receiving part
20 Upper plate part
22 Lower plate part
24 Side plate part
26 Side plate part
30 Lid part
34 Seal plate part
40 Seal part
42 Tub part
50 Oxidant supply part
52 Oxidant tank
53 Oxidant supply line
54 Oxidant pump
55 Opening
56, 56A to 56D Pipe
57 Nozzle
58, 58A, 58B Check valve
60 Flexible hose

62A, 62B Valve
64 Pipe
72 Acid solution circulation line
74 Acid solution circulation pump
76 Pipe
S Strip

The invention claimed is:

1. A pickling apparatus for pickling a strip of metal being conveyed, comprising:
a pickling tank for storing an acid solution;
a surrounding part disposed in the pickling tank so as to surround a strip immersed in the acid solution in the pickling tank; and
an oxidant supply part for supplying a liquid oxidant toward an inside of the surrounding part,
wherein the surrounding part includes an upper plate part and a lower plate part disposed so as to cover both faces of the strip, and a pair of side plate parts disposed so as to connect the upper plate part and the lower plate part on both sides of the strip.

2. The pickling apparatus according to claim 1,
wherein the surrounding part forms a passage for the acid solution along a conveying direction of the strip, and
wherein the passage has a passage decreasing part located downstream of an upstream end of the surrounding part in the conveying direction and having a smaller passage cross-sectional area than the upstream end.

3. The pickling apparatus according to claim 2, comprising:
a guide part disposed in the surrounding part and configured to guide the strip,
wherein the passage decreasing part is formed by the guide part.

4. The pickling apparatus according to claim 2,
wherein the oxidant supply part is configured to supply the liquid oxidant at a position upstream of the passage decreasing part in the conveying direction.

5. The pickling apparatus according to claim 1,
wherein the oxidant supply part is configured to supply the liquid oxidant at a position where a length from an upstream end of the surrounding part is above 0 and at most L/2, where L is a length of the surrounding part in a conveying direction of the strip.

6. The pickling apparatus according to claim 1,
wherein the oxidant supply part includes at least one pipe connected to the surrounding part and is configured to supply the liquid oxidant into the surrounding part via the pipe.

7. The pickling apparatus according to claim 6,
wherein the at least one pipe includes a plurality of pipes connected to the surrounding part at mutually different positions in a strip width direction of the strip.

8. The pickling apparatus according to claim 6, comprising:
a check valve disposed in the at least one pipe.

9. The pickling apparatus according to claim 1,
wherein the oxidant supply part includes a pipe penetrating at least either of the upper plate part or the lower plate part.

10. The pickling apparatus according to claim 1,
wherein the oxidant supply part includes a pipe penetrating at least either of the pair of side plate parts.

11. The pickling apparatus according to claim 1, comprising:
a lid part covering the pickling tank from above,
wherein the lid part is disposed to be openable and closable integrally with the upper plate part, and
wherein the oxidant supply part includes:
an oxidant tank for storing the liquid oxidant;
a pipe connected to the upper plate part; and
a flexible hose disposed between the oxidant tank and the pipe.

12. The pickling apparatus according to claim 1, comprising:
an acid solution circulation line configured to extract the acid solution from the pickling tank and return the acid solution toward the inside of the surrounding part in the pickling tank.

13. The pickling apparatus according to claim 12,
wherein the oxidant supply part includes a pipe connected to the acid solution circulation line, and is configured to supply the liquid oxidant toward the inside of the surrounding part via the acid solution circulation line.

14. A pickling method for pickling a strip of metal being conveyed, comprising:
a step of conveying the strip in a state where the strip is immersed in an acid solution stored in a pickling tank and the strip is surrounded by a surrounding part disposed in the pickling tank; and
a step of supplying a liquid oxidant toward an inside of the surrounding part,
wherein the surrounding part includes an upper plate part and a lower plate part disposed so as to cover both faces of the strip, and a pair of side plate parts disposed so as to connect the upper plate part and the lower plate part on both sides of the strip.

* * * * *